US008307864B2

(12) United States Patent
Dobkins

(10) Patent No.: US 8,307,864 B2
(45) Date of Patent: Nov. 13, 2012

(54) SYSTEMS AND METHODS FOR VACUUM SEALING

(76) Inventor: Chris Dobkins, San Francisco, CA (US)

( * ) Notice: Subject to any disclaimer, the term of this patent is extended or adjusted under 35 U.S.C. 154(b) by 1112 days.

(21) Appl. No.: 12/181,261

(22) Filed: Jul. 28, 2008

(65) Prior Publication Data

US 2009/0026401 A1 Jan. 29, 2009

Related U.S. Application Data

(60) Provisional application No. 60/962,250, filed on Jul. 27, 2007, provisional application No. 61/001,486, filed on Oct. 31, 2007.

(51) Int. Cl.
*B65B 1/04* (2006.01)

(52) U.S. Cl. ..... 141/329; 141/8; 141/65; 141/114; 141/313

(58) Field of Classification Search ..... 141/8, 65, 141/114, 313, 329; 99/454, 472; 383/3
See application file for complete search history.

(56) References Cited

U.S. PATENT DOCUMENTS

| | | | | |
|---|---|---|---|---|
| 5,121,840 | A * | 6/1992 | Schram | 206/522 |
| 5,450,963 | A * | 9/1995 | Carson | 206/524.8 |
| 6,581,641 | B2 | 6/2003 | Skeens et al. | |
| 6,634,384 | B2 | 10/2003 | Skeens et al. | |
| 6,932,509 | B2 * | 8/2005 | Shah et al. | 383/103 |
| 7,614,203 | B2 * | 11/2009 | Oltrogge | 53/434 |
| 2003/0178066 | A1 * | 9/2003 | Skeens et al. | 137/512.15 |
| 2004/0238397 | A1 * | 12/2004 | Yu et al. | 206/524.8 |
| 2005/0172577 | A1 | 8/2005 | Oltrogge | |
| 2007/0269143 | A1 | 11/2007 | Hickey | |
| 2008/0099708 | A1 | 5/2008 | Lee | |

OTHER PUBLICATIONS

FoodSaver® Appliances, (2007), retrieved from http://web.archive.org (1 pg.).
Black & Decker® Appliances; FreshGuard® Professional-Performance Vacuum System and Canister Set (2005), retrieved from http://web.archive.org (3 pgs.).
Black & Decker® freshGUARD® Professional-Performance Vacuum System (Jul. 6, 2004), retrieved from http://www.blackanddeckerappliances.com/product-186.html (14 pgs.).
Black & Decker FreshGUARD Professional-Performance Vacuum System Canister Set Model VC 200, VC200C (Jul. 28, 2003) (I pg.).
Black & Decker FreshGuard Professional-Performance Vacuum System SKU: VC200C (2005) (1 pg.) http://www.blackanddeckerappliance.com/product-186.html.
Pump-N-Seal—the Food Saver (prior to Jul. 27, 2007); retrieved from http://web.archive.org/web/20070610091616/http://www.pump-n-seal.com/info.htm (2 pgs.).
The Gourmet Retailer: 2004 New York Gourmet Housewares Show: Premiere Show Brings Home Focus to New York (Dec. 1, 2004), retrieved from http://www.gourmetretailer.com (3 pgs.).

(Continued)

*Primary Examiner* — Gregory L. Huson
*Assistant Examiner* — Jason K Niesz
(74) *Attorney, Agent, or Firm* — Blakely, Sokoloff, Taylor & Zafman LLP

(57) ABSTRACT

A valve assembly for vacuum sealing a collapsible storage bag including a first valve part and a second valve part. The first valve part being inserted into the second valve part with a wall of the bag in between, causing the wall of the bag to break and/or puncture. A valve sealing mechanism to control the air flow from within the bag through the first and second valve part and out the bag.

12 Claims, 8 Drawing Sheets

OTHER PUBLICATIONS

Product Comparison Table (Jun. 22, 2007), retrieved from http://web.archive.org/web/20070622070423/http://www.pump-n-seal.com/comparison.htm (1 pg.).
Product Comparison Table (prior to Jul. 27, 2007); retrieved http://www.pump-n-seal.com/comparison_htm (1 pg).
Rival Seal*a*Meal (Jun. 24, 2007), retrieved from http://web.archive.org/web/20070624102324/http://www.sealameal.com/ (1 pg.).
Pump and Seal—Food Saver Vacuum Sealer (Jul. 1, 2007); retrieved from http://web.archive.org/web/20070701070111/http://www.pump-n-seal.com/index.htm (2 pgs.).
FoodSaverShop.com: The secret's in the packaging (May 10, 2006), retrieved from http://web.archive.org (3 pgs.).
FoodSaverShop.com: FoodSaver Online Retailer (May 27, 2007): retrieved from http://web.archive.org/web/20070527131159/http://www.foodsavershop.com/foodin.html (1 pg.).
FoodSaverShop.com: FoodSaver Online Retailer (Jun. 30, 2007), retrieved from http://web.arehive.org (2 pgs.).
Vac 550 User Manual: FoodSaver, The Original Home Vacuum Packaging System by Tilia, (Jun. 2000), (23 pgs.).
Vac 1050 User Manual: FoodSaver, The Original Home Vacuum Packaging System by Tilia, (Aug. 2000), (25 pgs.).
Professional II User Manual: FoodSaver. The Original Home Vacuum Packaging System by Tilia, (May 2001), (22 pgs.).
Pump-N-Seal, (Apr. 24, 2009) http://www.pump-n-seal.com/pumpseal.htm (2 pgs.).
Vacu Pac Dry Box System (Apr. 27, 2009); http://www.vacupac.com (4 pgs.).
Adorama VacuPac Dry Box, Small (3.5 lit.) with Built-in Hygrometer, (Jun. 17, 2003); http://www.amazon.com/Adorama-VacuPac-small-Built-Hugrometer/dp/B000M5DR3K, (3 pgs).
Rival Seal-*a*-Meal (2007), http://web.archive.org/web/20070815072243/www.sealameal.com/why/how_work/ (1 pg.).
How to Vacuum Seal with Seal-A-Meal Bags (Feb. 19, 2005); (1 pg).
What's In Storage? Vacuum Packaging System for Food Evolve Past Plain Old Plastic Wrap (Jun. 21, 2004), http://www.highbeam.com/doc/1G1-118588390.html, (2 pgs.).
Who Needs Air Anyway? (May 23, 2004), http://www..highbeam.com/doc/1P2-6283385.html (2 pgs.).
Decosonic Pak'n Save Food Vacuum Sealer Model 838 (Apr. 28, 2009) (4 pgs.).
Decosonic Vacuum Bag Food Sealer (Nov. 4, 2008); http://vancouver.en.craigslist.ca/hsh/919140388.html (1 pg.).
Decosonic Vacume [sic] Bag Sealer (Feb. 28, 2009); (1 pg.).
Decosonic Bag Sealer with Extra Bags (Apr. 12, 2009); (1 pg.).
Creative Gear Pump N Store Vacuum Food Saver & Storage Container (Apr. 28, 2009), (2 pgs.).
4-Pc. Pump-N-Store Set (Aug. 14, 2009); retrieved from http://www.amazon.com (4 pgs.).
Chris Yonge, The Assembly of Two Competing Units to the Snap and Seal Concept, Studio Cruz (Feb. 2008); (3 pgs.).

* cited by examiner

SYSTEMS AND METHODS FOR VACUUM SEALING

PRIORITY

This application claims the benefit of U.S. Provisional Application No. 60/962,250, filed Jul. 27, 2007, the entirety of which is incorporated by reference, and 61/001,486 filed Oct. 31, 2007, the latter which is not incorporated by reference.

FIELD OF THE INVENTION

This invention relates to the field of vacuum sealing and, in particular, to hand-held vacuum sealing.

BACKGROUND

Vacuum sealing is typically used for storing food, clothing and the like to improve the life of the product being stored. Vacuum sealing can be used to prevent or reduce the likelihood of, for example, oxidation, dehydration, freezer burn, mold formation and growth of bacteria.

One device used for vacuum sealing is a countertop device. The countertop device requires plastic bags that are designed to work only with the countertop device. The countertop device includes a nozzle, a pump, and a sealing device. The vacuum is removed from the bag, and then the bag is sealed. These countertop devices and the bags are typically expensive and can be difficult to use.

Another device used for vacuum sealing clothing or other household items involves bags with a valve built-in to the bag. A standard, house-hold vacuum is then connected via a hose to the valve to remove air from the bag.

BRIEF DESCRIPTION OF THE DRAWINGS

Embodiments of the invention are described by way of example with reference to the accompanying drawings, wherein.

DETAILED DESCRIPTION

Figure 1:
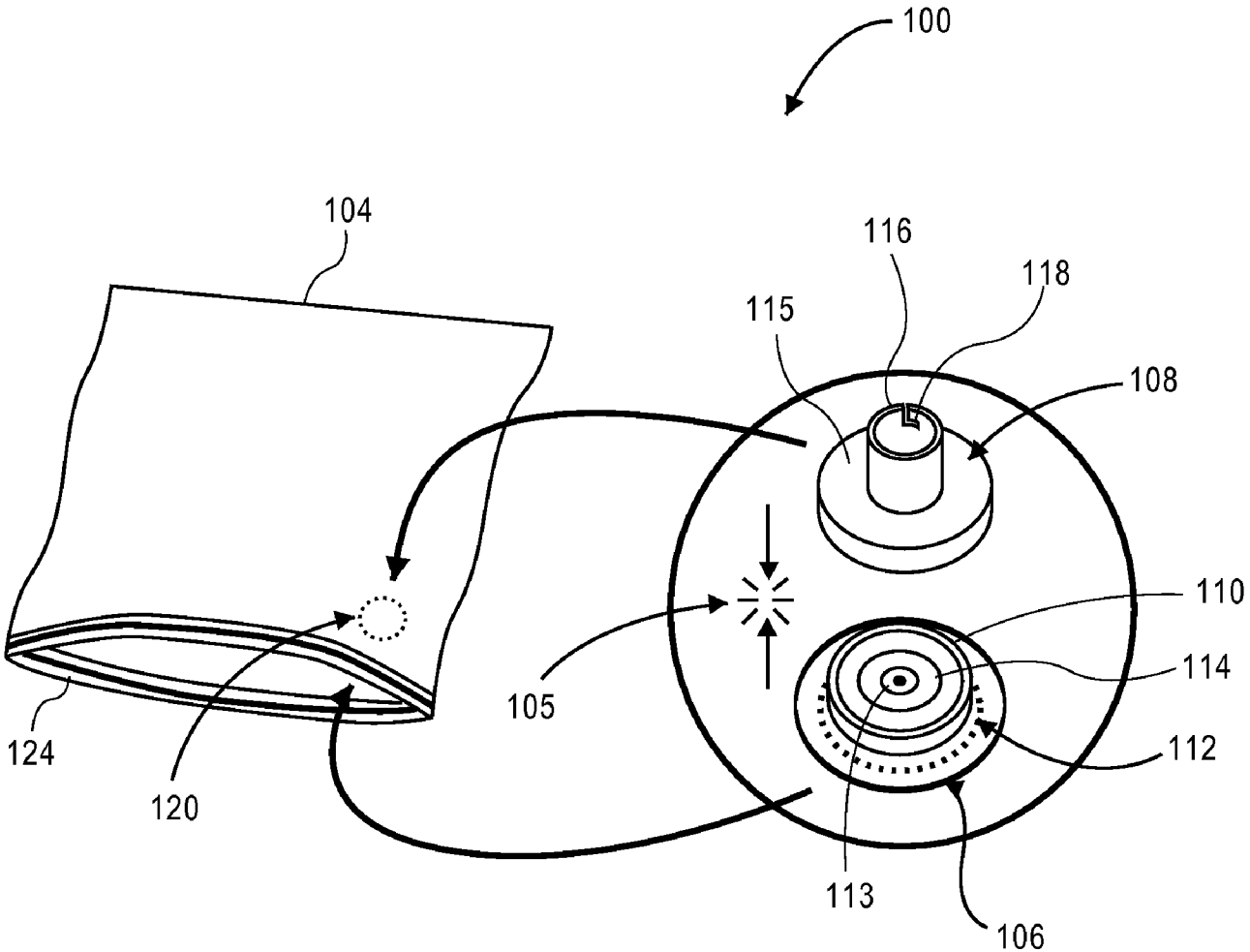
FIG. 1 is a perspective view of a valve in accordance with one embodiment of the invention.

FIG. 1 is a perspective view of a vacuum sealing system 100. The vacuum sealing system 100 includes a bag 104 and a valve 105. The valve 105 includes a first valve part 106 and a second valve part 108. The first valve part 106 and second valve part 108 are adapted to connect to one another, as will be described in further detail hereinafter.

The first valve part 106 includes a protrusion 110 and a plurality of projections 112. The protrusion 110 includes a plurality of openings 113 and a sealing element 114. The plurality of projections 112 are adapted to couple the first valve part 106 with the bag 104, as described in further detail hereinafter. The projections 112 may include a pointed or sharp end to ease puncturing of the bag 104. The projections 112 may be configured to anchor the first valve part 106 to the bag 104. For example, the projections 112 may be hook-shaped to anchor the first valve part 106 to the bag 104. The projections 112 may have beveling on the surface of the base of the first valve part 106. The plurality of openings 113 are configured to fluidly interconnect the interior of the bag 104 with the valve 105 and a vacuum (not shown). It will be appreciated that one opening may be used as opposed to the illustrated openings. Similarly, the number of projections may vary from that illustrated. In addition, the shape and size of the openings and/or projections may vary from that illustrated in FIG. 1. In one embodiment, the sealing element 114 is an o-ring, a food-safe adhesive, and/or a latex material. It will be appreciated that other sealing elements as known to those of skill in the art may be used.

The second valve part 108 includes a base 115 and a protrusion 116. The protrusion 116 includes an opening 118. The base 115 is configured to conform to the first valve part 106. That is, the base 115 is configured to fit over the protrusion 110 and sealing element 114 to create an air-tight seal between the first valve part 106 and the second valve part 108 when connected together. The protrusion 116 is configured to connect with a vacuum via the opening 118, and fluidly connect the interior of the bag 104 with the vacuum via openings 113, as described in further detail hereinafter.

The valve 105 may additionally include a sealing component (not shown) to seal openings 113 relative to the bag 104 after air is removed from the bag 104, as described in further detail hereinafter. For example, the valve 105 may include a lid. In another example, the valve 105 may include an actuable, internal mechanism that is moved to cover the openings 113.

The valve 105 may also include a screen mesh at the bottom of the valve assembly to prevent particles from affecting the valve operation.

The bag 104 includes a seal 124. When food or other items to be stored are placed in the bag, the valve 105 is connected to the bag 104 at location 120 as described in further detail hereinafter. It will be appreciated that location 120 may vary from the illustrated location. The bag 104 may be a conventional, securable storage bag, such as, ZIPLOC® bags. The seal 124 of the bag 104 may be a zipper or hand-sealable seal, as known in the art. It will be appreciated that the bag 104 may be any size and/or any shape.

In use, the first valve part is placed inside the bag 104 and the projections 112 are adapted to puncture through the bag 104 at a location 120. The second valve part 108 is secured to the first valve part and creates a seal between the first valve part 106 and the second valve part 108. In one embodiment, the first valve part 106 and second valve part 108 are snapped together.

Figure 2:
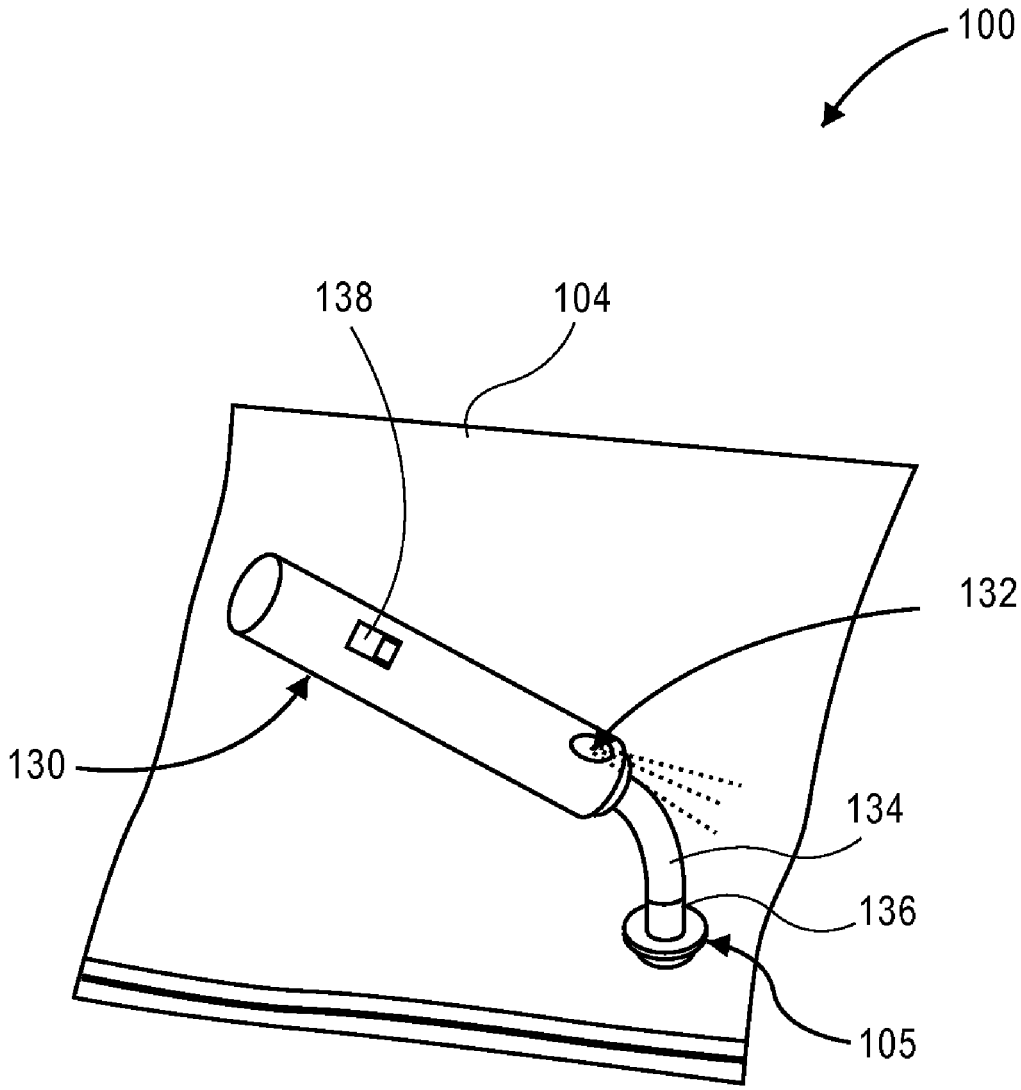
FIG. 2 is a schematic view of a hand-held vacuum in accordance with one embodiment of the invention.

A vacuum 130 is then attached to the seal 105, as shown in FIG. 2. In FIG. 2, the illustrated vacuum 130 is a hand-held vacuum device. The vacuum 130 may be battery-operated to improve portability of the vacuum 130.

The vacuum 130 includes an opening 132, a hose 123, an attachment element 136 and a power switch 138. The vacuum 130 includes a pump (not shown) within the housing to create a vacuum that removes air from the bag 104. It will be appreciated that other mechanisms for removing air from the bag 104 may be used.

The pump of the vacuum 130 is turned on by actuating the power switch 138. The pump removes air from the bag through the openings 113 of the valve 105, hose 123 and attachment element 136. In one embodiment, the air removed from the bag is expelled through the opening 132. It will be appreciated that the vacuum may remove other fluids besides air, as needed.

Figure 3:
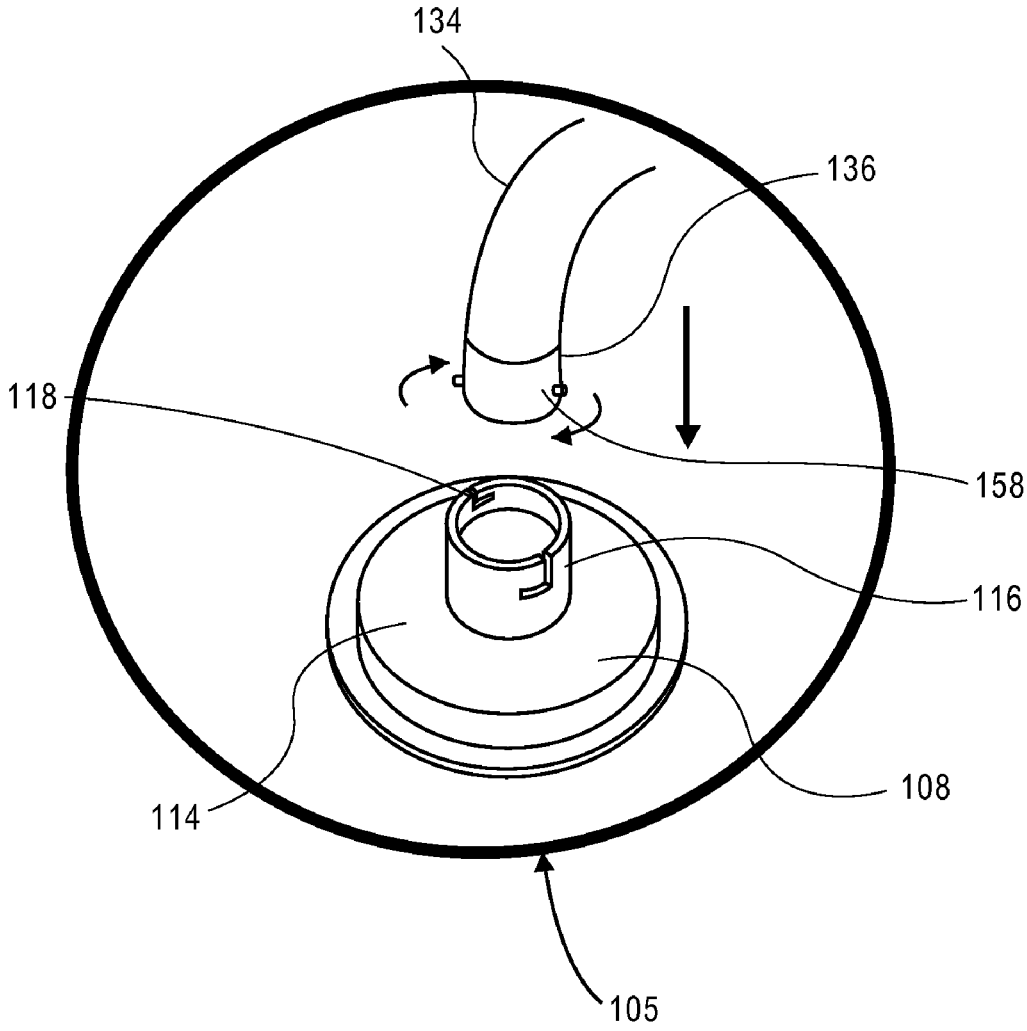
FIG. 3 is a detailed perspective view of the valve and hand-held vacuum connection in accordance with one embodiment of the invention.

FIG. 3 illustrates the connection between the valve 105 and the vacuum 130 in further detail. The attachment element 136 of the hose 123 includes projections 138 adapted to fit in opening 118 of valve 105. It will be appreciated that the particular method for connecting the vacuum 130 and valve 105 may vary from that illustrated in FIG. 3.

Figure 4:
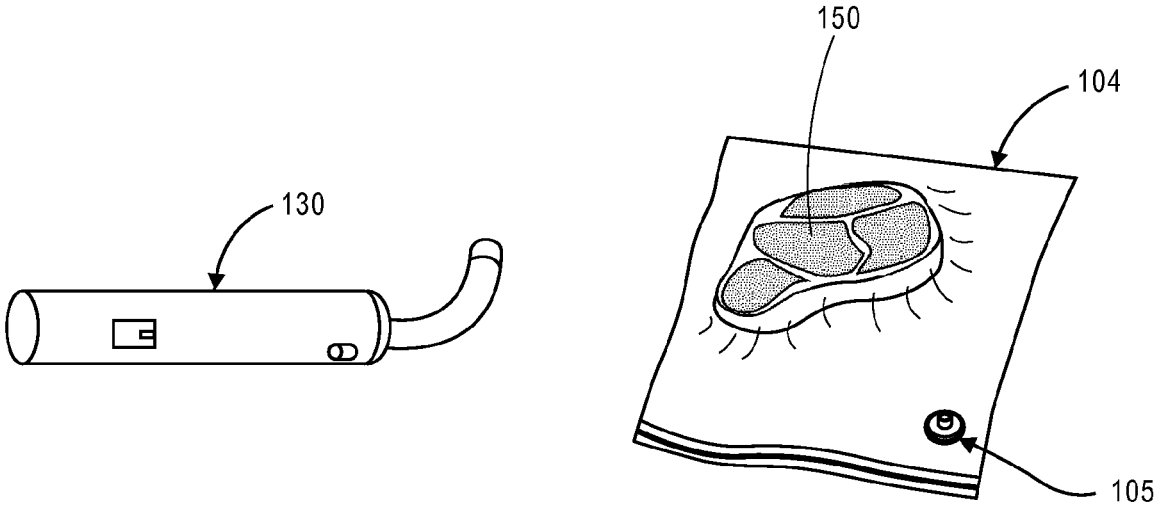
FIG. 4 is a perspective view of a sealed product in accordance with one embodiment of the invention.

Referring to FIG. 4, when the item 150 to be stored is sufficiently sealed, the vacuum 130 can be removed from the valve 105. It will be appreciated that the valve 105 remains connected with the bag so long as the item to be stored is within the bag 104. In some embodiments, the valve may be releasably secured to the bag 104 such that the valve 105 can be reused.

Figure 5B:
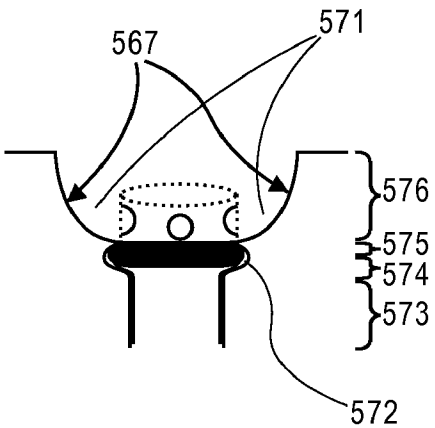
FIG. 5*b* illustrates how the first valve part is inserted and secured into second valve part, according to one embodiment of the invention.
Figure 5A:
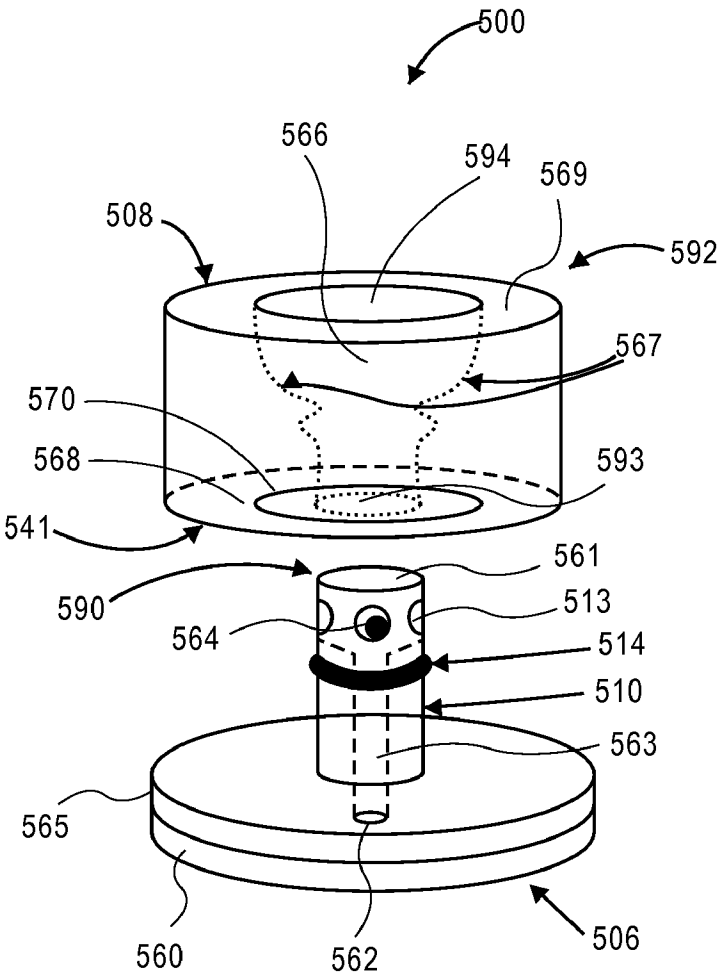
FIG. 5*a* is a perspective view of a valve assembly according to one embodiment of the invention.

FIG. 5*a* is a perspective view of a valve assembly according to one embodiment of the invention. Valve assembly 500 comprises a first valve part and a second valve part that are adapted to connect to one another, as will be described in further detail hereinafter.

First valve part 506 includes a base component 560 and protrusion 510 extending from the base component 560 to a protrusion surface component 561 at a distal end 590. The protrusion 510 further includes openings 513 near the distal end of the protrusion and sealing element 514. Base component 560 includes an opening 562. A cavity 563, illustrated with dotted lines, extends from opening 562 to the openings 513 within the protrusion 510, and contained within cavity 563 is a ball 564. Also illustrated in this embodiment is sealing element 565 on base component 560. A screen (not shown) may be located at the opening 562 or within the cavity 563 in order to protect the valve assembly from food particles.

Second valve part 508 includes a bottom surface component 568 at a receiving end 591 of the second valve part 508, top surface component 569 at a distal end 592 of the second valve part 508, inner walls 567 and cavity 566 which extends through the second valve part 508 from an opening 593 at the receiving end to an opening 594 at the distal end. A sealing element 570 may be located on the bottom surface component 568 to create an airtight seal between the first valve part 506 and the second valve part 508. Another sealing element may be located on the outside of the second valve part 508 near the top surface component 569 to create an airtight seal between the second valve part 508 and pump (not shown).

Figure 7A:
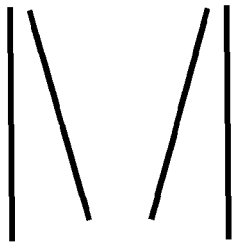
FIGS. 7*a-e* illustrate various exemplary embodiments with varying widths between inner walls of a valve cavity.
Figure 7B:
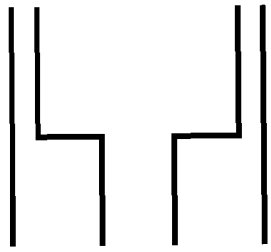
Figure 7C:
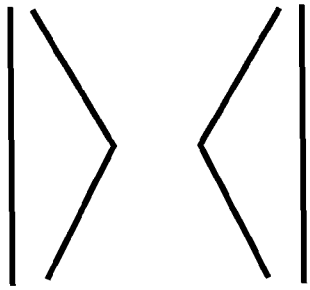
Figure 7D:
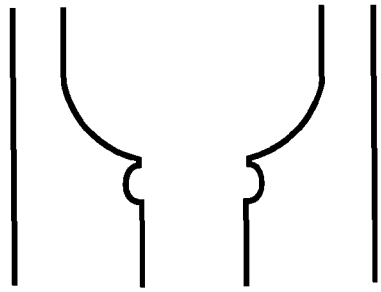
Figure 7E:
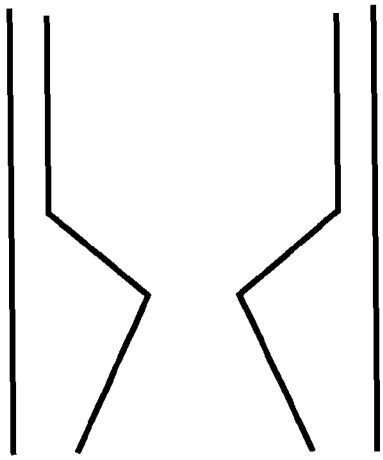

The width of the cavity 566 within the inner walls 567 varies in length from the bottom surface component 568 and top surface component 569. Specifically, a portion of the inner walls 567 near the top surface component 569 has a width greater than a portion of the inner walls 567 that is closer to the bottom surface component 568. FIG. 7*a-d* illustrates various exemplary embodiments with a portion of the inner walls 567 near the top surface component 569 has a width greater than a portion of the inner walls 567 that is closer to the bottom surface component 568. FIG. 7*a* illustrates one embodiment wherein the increase in width is gradual. In another embodiment, the increase in width of the inner walls 567 occurs at a certain distance along the axis of cavity 566. This is illustrated in FIGS. 7*b-e*. Note that a plurality of portions with varying widths may exist as illustrated in FIGS. 7*d-e*. It should be understood that these are exemplary embodiments and that various other shapes of the inner walls 567 may be used without compromising the underlying principles of the invention.

In use, the first valve part 506 is inserted and secured into the second valve part 508 with a wall of the bag in between. Specifically, the bottom surface component 561 is placed over protrusion 510 and pressed against base component 560 of the first valve component 560 (or against sealing element 565 if used) with the bag positioned in between. Sealing element 570 may also be used instead or in addition to sealing element 565 to create an airtight seal between the first and second valve parts 506,508.

When protrusion 510 is inserted into cavity 566, openings 513 pass the portion of the inner walls 567 with the smaller width and come to a final position aligned with the portion of the inner walls 567 that are greater in width. Sealing element 514 is positioned so as to create an airtight seal against the inner walls 567. In one embodiment, sealing element 514 is positioned against the portion of the inner walls with a smaller width. In another embodiment, sealing element 514 is positioned within a groove with a greater width, as illustrated in FIG. 5*b*.

FIG. 5*b* illustrates how the first valve part 506 is inserted and secured into second valve part 508, according to one embodiment of the invention. Only a portion of each valve part is illustrated. Inner walls 567 have been indicated with four portions 573,574,575,576, each portion having a specific width. Portions 573,575 have smaller widths than portions 574,576. Portions 573,575 are not necessarily equal in size, but are both very close in size to the width of protrusion 510. In this embodiment, sealing element 514 is positioned within groove 572 at portion 574. Openings 513 are aligned at portion 576 when first valve part 506 is completely inserted into second valve part 508. Spaces 571 are formed between protrusion 510 and inner walls 567 (where the width is greater), creating passageway for air when the vacuum is operating. In the embodiment shown, sealing element 514 is positioned within groove 572 at portion 574 so as to create an airtight seal against the inner walls 567. Note that sealing element 514 may be positioned at portion 573, 575, or 576 and still function to create an airtight seal. In one embodiment, groove 572 is selected with a large enough width so as to create a zone where sealing element 514 encounters less frictional resistance, thus allowing the protrusion 510 to "snap" into the second valve part 508 with the sealing element 514 securing against portion 575 of the inner walls 567.

As stated earlier, the width at portions 573,575 are very close to the width of protrusion 510, and in particular, the width of protrusion surface component 561. The tolerances between the protrusion surface component 561 and portions 573,575 are selected so as to create a tight enough fit that the protrusion 510 stretches and/or damages the bag as it enters cavity 566, eventually causing the bag to rip, tear, cut, etc. It should be noted that the term "break" is used herein to describe any ripping, tearing, cutting, etc. of the wall of the bag. In one embodiment, the tolerances are also selected so as to create a tight enough fit that the edges of the protrusion surface component 561 assist in breaking the wall of the bag as it contacts portions 573,575. A chad may be formed in the shape of the protrusion surface component 561. A plurality of contact points may exist (e.g., the embodiment shown in FIG. 5*b*, two contact points at portions 573,575 exist) to provide additional assistance in forming a chad. In another embodiment, a single contact point is used.

If the contact damages the bag but does not form a complete chad, then the additional stretching of the bag will induce a chad to be formed, or at the least, cause additional breakage of the wall of the bag. It should also be noted that sealing element 514 provides additional resistance to assist in stretching the wall of the bag. Sealing element 514, when used in conjunction with groove 572, provides for a more violent movement (i.e., "snap") which further assists in stretching the bag and forming a chad or breaking the wall of the bag. Thus, the sealing element may provide for additional functions than just creating an airtight seal.

As protrusion 510 is inserted further into second valve part 508, it is pushed through the break in the wall of the bag until openings 513 are located within space 577. Once first valve part 506 and second valve part 508 are completely secured together, a vacuum may be connected to the second valve part 508 to draw air out of the sealed bag 104. Before the vacuum is activated, ball 564 is positioned in cavity 563 so as to block any air passage. When the vacuum is activated, ball 564 is pulled away from its position and allows air to pass. Air may now pass from inside the bag, through opening 562, through cavity 563, through openings 513, through space 577, and into the vacuum. When the vacuum is deactivated or pulled off the second valve part 508, ball 564 is again positioned to block air passage in cavity 563. In one embodiment, ball 564 falls back to its blocking position due to its weight and/or suction created from the vacuum sealed bag. In another embodiment, a spring or similar mechanism is used to reposition the ball 564 in its blocking position. It should be noted that many internal valve sealing mechanism are well known in the art and may be implemented without compromising the underlying principles of the invention.

Figure 6A:
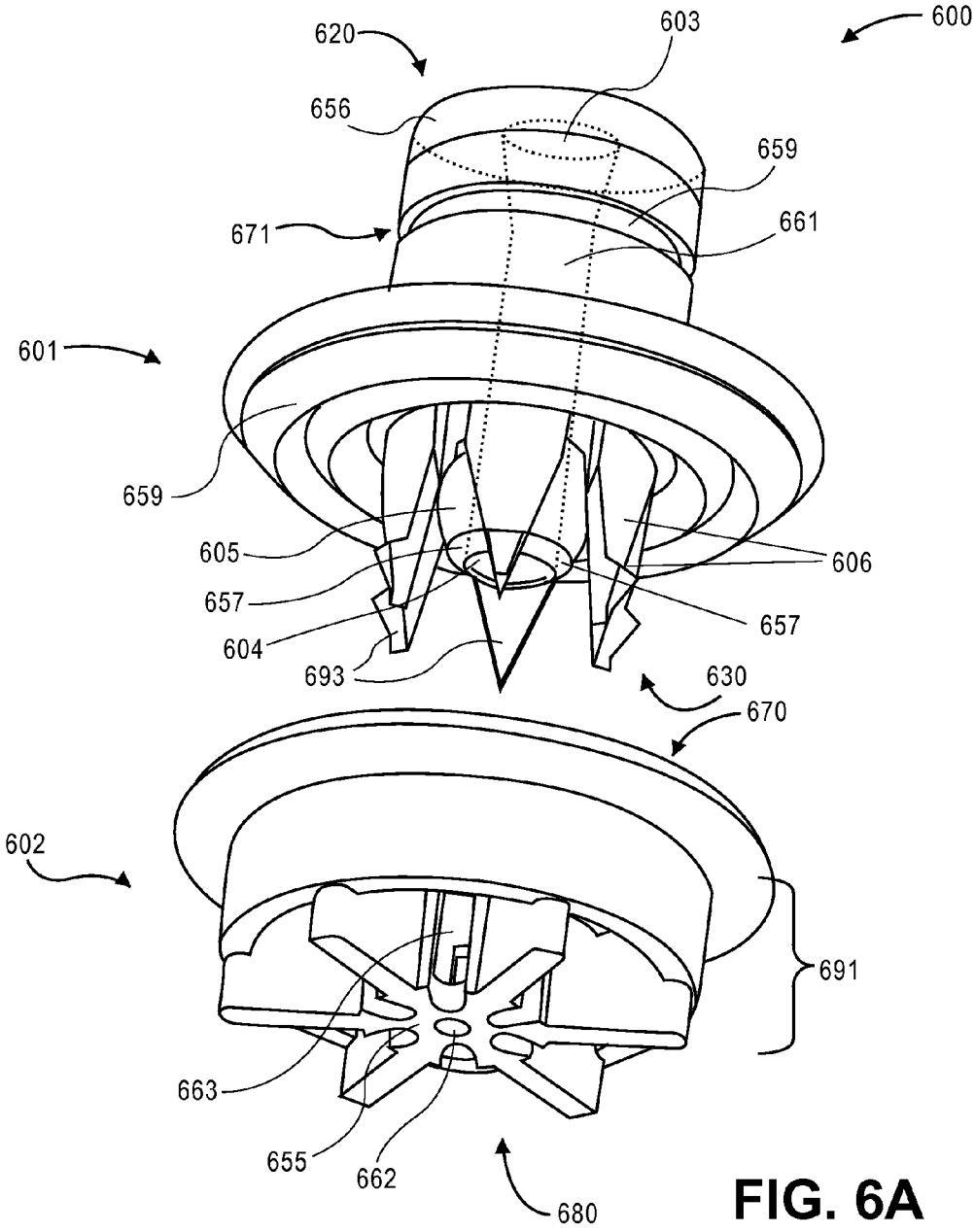
FIGS. 6*a* & 6*b* are a perspective views of a valve assembly according to one embodiment of the invention.
Figure 6B:
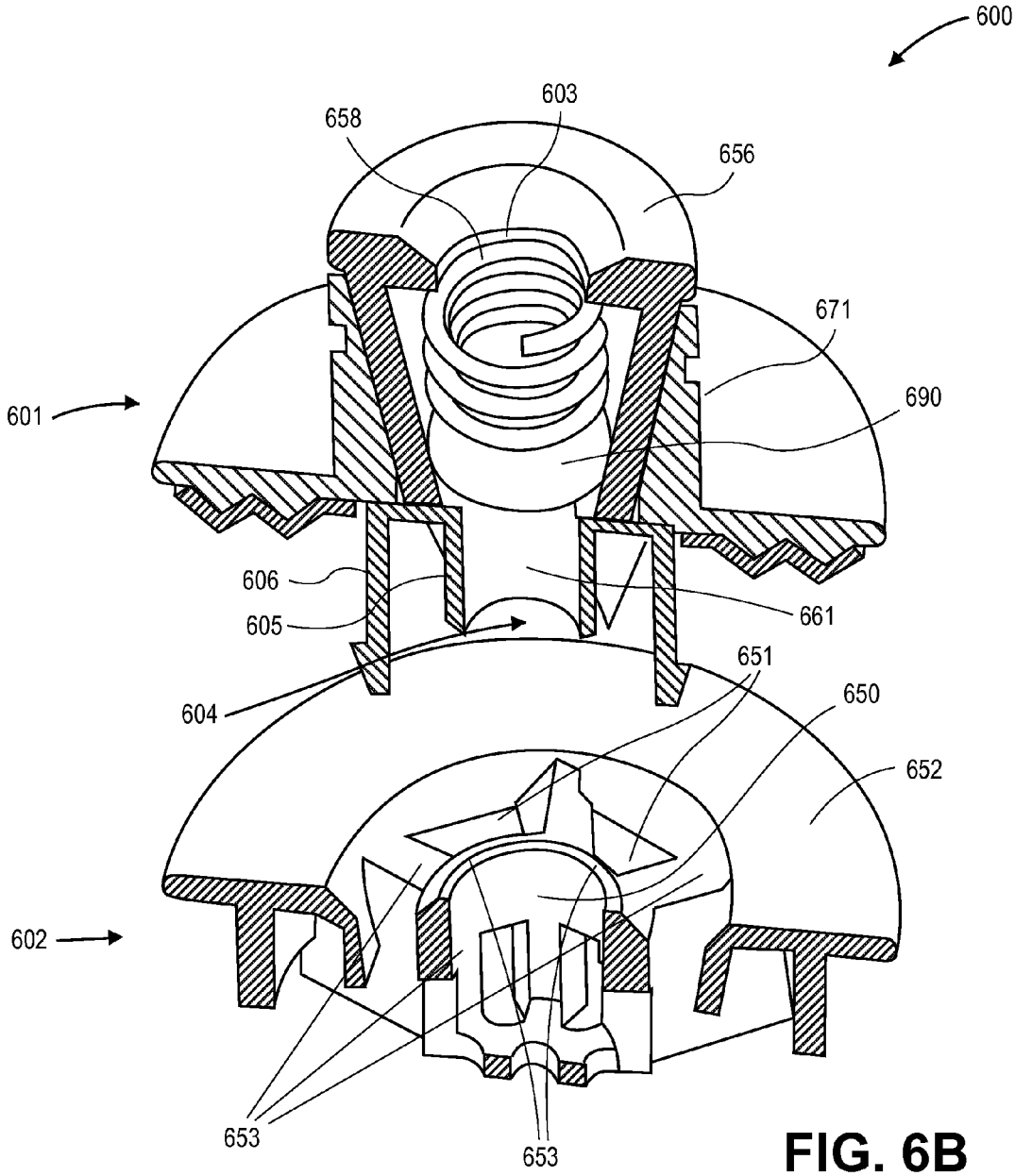

FIGS. 6*a* & 6*b* are a perspective views of a valve assembly according to one embodiment of the invention. FIGS. 6*a* and 6*b* are described in the following paragraphs together for easier understanding. Valve assembly 600 includes a first valve part 601 and a second valve part 602. A base component 671 includes a base surface component 656 (also shown with dotted lines) forming an opening 603 (also shown with dotted lines), which can connect to a vacuum pump (not shown). A main protrusion 605 and snap projections 606 extend from the base component 671 to a distal end 630 of the first valve part 601. A cavity 661 (also shown with dotted lines) extends from opening 603 through main protrusion 605 to opening 604 formed at the distal end 630 of the first valve part 601. Opening 604 is formed by protrusion surface component 657. A ball 690 is positioned within the cavity to control the passage of air within the cavity in a similar manner as described above for FIGS. 5*a* & 5*b*. As illustrated in FIG. 6*b*, a spring 658 may be used to assist in positioning the ball. It should be noted that many internal valve sealing mechanisms are well known in the art and may be implemented.

Second valve part 602 includes a top surface component 652 at a receiving end 670 and a casing portion 691 at a distal end 680. Casing portion 691 includes inner walls which form a main opening 650 into a cavity 663, and snap openings 651 into spaces defined between inner walls 653 which extend to the distal end 680 of the second valve part 602. Main opening 650 and snap openings 651 receive main protrusion 605 and snap projections 606 of the first valve part 601, respectively. Snap projections 606 may have hinge-like attachments 693 causing the snap projections to lock into place. Distal surface component 655 forms opening 662. The spaces between inner walls 653 which extend all the way to the distal end 680 are connected to cavity 663 such that air may flow between the two areas.

In use, first valve part 601 is inserted into second valve part 602 with a wall of bag 104 in between. Specifically, main protrusion 605 and snap projections 606 are inserted into main opening 650 and snap openings 651, respectively. Inner walls 653 are configured to form an opening in cavity 650 which is in the shape of main protrusion 605. Tolerances are selected so as to create a tight enough fit that the wall of the bag is stretched and eventually breaks during insertion. In one embodiment, the tolerances are selected so as to create a tight enough fit that the edges of main protrusion surface component 657 assists in breaking the wall of the bag when coming into contact with bars 654 (or sufficiently damaging the wall of the bag at the point of contact so that additional stretching will induce a break in the wall of the bag). Snap projections 606 are pointed and pierce the bag as it enters snap openings 651. The snap projections 606 may also stretch the bag causing it to exacerbate the break. When fully inserted, the hinge-like attachments 693 of snap projections 606 lock into place and securing the first valve part 601 with the second valve part 602.

First valve part 601 includes sealing element 659 which is positioned around the main protrusion 605 and snap projections 606, creating an airtight seal when pressed between first valve part 601 and second valve part 602.

When the first valve part 601 is fully inserted into second valve part 602, a vacuum pump can be connected to the distal end 620 of first valve part 601. A sealing element 659 may be used to create an airtight seal between the first valve part and the vacuum pump. A ball 690 is positioned within the cavity to control the passage of air within the cavity in a similar manner as described above for FIGS. 5*a* & 5*b*. Spring 658 may also be used to keep the ball in its blocking position. When the vacuum pump is activated, the ball is pulled away from cavity 661 and allowing air to pass from within bag 104, through opening 603 and spaces within casing portion 607, through cavity 650 within main protrusion 605, and through opening 603. When the vacuum pump is disconnected or deactivated, the ball returns to its blocking position (e.g., by force of spring 658) and creating a vacuum seal. It should be noted that many internal valve sealing mechanisms are well known in the art and may be implemented.

Casing portion 607 not only forms spaces and openings to maximize air flow, but also provides a wall structures which prevents the walls of the bag 104 from clogging the air passage way. For example, if a single opening is used, the bag could possibly clog the opening if it were to be sucked into the opening. In one embodiment, the main protrusion 605, when fully inserted, does not extend to the distal surface component 655. Thus, the spaces formed between the inner walls 653 remain connected to the cavity 663 and provide other openings to bag 104 than just opening 662. Casing portion 607 also provides structural support and a stable base so pressure can be applied when inserting the first valve part 601 into the second valve part 602.

One advantage of the systems and methods described herein is that the vacuum sealing system is portable. Thus, users are not limited by the lack of mobility of the counter-top vacuum sealing systems.

Another advantage of the systems and methods described herein is that the cost of the system is less expensive than conventional systems.

A further advantage of the systems and methods described herein is that the valve can be used with any sealable bag. Users therefore have the ability to select the particular size and shape of the bag they want to use with greater flexibility than conventional systems.

In the foregoing specification, the invention has been described with reference to specific exemplary embodiments thereof. It will, however, be evident that various modifications and changes may be made thereto without departing from the broader spirit and scope of the invention. The specification and drawings are, accordingly, to be regarded in an illustrative sense rather than a restrictive sense.

What is claimed is:

1. A valve assembly comprising:

a first valve part having a base component, a protrusion and plurality of snap projections extending from the base component, and a valve sealing mechanism;

a second valve part having a receiving end and a distal end, the receiving end of the second valve part configured to receive the protrusion and the plurality of snap projections when the first valve part is inserted into the second valve part with a wall of a bag between the first valve part and the second valve part, wherein the plurality of snap projections have a distal end which is shaped to puncture the bag upon insertion of the first valve part into the second valve part, the first valve part and the second valve part forming an airtight seal when connected together, and the second valve part having a surface component at the distal end for connection to a vacuum pump.

2. The valve assembly of claim 1 wherein the valve sealing mechanism includes an actuable internal mechanism that moves to cover openings in the first valve part.

3. The valve assembly of claim 1 wherein the valve sealing mechanism is configured to allow air flow when suction is applied to the second valve part and blocking air flow when suction is not applied to the second valve part.

4. The valve assembly of claim 1 wherein the first valve part further includes a screen to prevent particles from affecting valve operation.

5. The valve assembly of claim 1 wherein the first and second valve part are snapped together.

6. A valve assembly comprising:

a first valve part having a base component, a main protrusion and plurality of snap projections extending from the base component, a protrusion surface component at a distal end of the main protrusion, a first cavity extending from a first opening in the base component to a second opening at the distal end of the main protrusion, and a valve mechanism to control the air flow through the cavity; and a second valve part having inner walls forming a main opening and plurality of snap openings at a receiving end of the second valve part, the inner walls also forming a second cavity extending from the main opening to a third opening at a distal end of the second valve part;

wherein the first and second valve part are configured to fit together with a wall of a bag in between, the main protrusion and plurality of snap projections inserting into the main opening and plurality of snap openings, respectively, and wherein the plurality of snap projections have a distal end which is shaped to puncture the bag when the first and second valve part are connected together.

7. The valve assembly of claim 6 wherein the main protrusion includes a protrusion surface component with edges that damage the bag as it contacts the inner walls forming the second cavity, the damage promoting the bag to break where contacted.

8. The valve assembly of claim 6 further comprising a sealing element to create an airtight seal, the sealing element positioned between the first and second valve part around the main protrusion and plurality of snap projections.

9. The valve assembly of claim 6 wherein the plurality of snap projections include a catch at a distal end of each snap projection, the catches locking into the second valve part when completely inserted.

10. The valve assembly of claim 6 wherein the inner walls also form a plurality of spaces between the inner walls, the spaces extending to the second cavity so that air may pass between the plurality of spaces to the second cavity and to the second opening at the distal end of the main protrusion when completely inserted.

11. The valve assembly of claim 10 wherein the distal end of the main protrusion extends into only a portion of the second cavity of the second valve part when fully inserted.

12. A method for vacuum sealing a collapsible storage bag, comprising:

inserting a first valve part into a second valve part with a wall from the bag in between, wherein the first valve part includes a plurality of snap projections and wherein the plurality of snap projections have a distal end which is shaped to puncture the bag when the first and second valve part are connected together;

puncturing the bag with a plurality of snap projections when the first valve part is inserted into the second valve part;

sealing the first valve part and second valve part when the first valve part is inserted into the second valve part;

sealing the opening of the bag;

providing suction to the second valve part to allow air to flow from the inside of the bag through the first and second valve part and out the bag; and blocking an opening in the first valve part using an internal valve sealing mechanism so as to vacuum seal the bag.

* * * * *